US010828642B2

(12) United States Patent
Doyle et al.

(10) Patent No.: US 10,828,642 B2
(45) **Date of Patent: *Nov. 10, 2020**

(54) INTEGRATED CARTRIDGE HOUSINGS FOR SAMPLE ANALYSIS

(71) Applicant: Abbott Point of Care Inc., Princeton, NJ (US)

(72) Inventors: Kevin John Doyle, Dunrobin (CA); Paul Wilkins, Cambridge (GB); Mick Withers, Impington (GB); Adrian Cooper, St. Ives (GB); John Oakey Noell, Skillman, NJ (US)

(73) Assignee: ABBOTT POINT OF CARE INC., Princeton, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/526,275

(22) Filed: Jul. 30, 2019

(65) Prior Publication Data

US 2019/0351406 A1 Nov. 21, 2019

Related U.S. Application Data

(60) Continuation of application No. 15/419,097, filed on Jan. 30, 2017, now Pat. No. 10,406,523, which is a (Continued)

(51) Int. Cl.
*B01L 3/00* (2006.01)

(52) U.S. Cl.
CPC ..... *B01L 3/508* (2013.01); *B01L 3/5055* (2013.01); *B01L 2200/04* (2013.01); (Continued)

(58) Field of Classification Search
CPC .... B01L 3/508; B01L 3/5055; B01L 2200/10; B01L 2200/12; B01L 2300/123; (Continued)

(56) References Cited

U.S. PATENT DOCUMENTS 4,444,711 A 4/1984 Schad
4,460,534 A 7/1984 Boehm et al.
(Continued)

FOREIGN PATENT DOCUMENTS

CN 1185050 1/2005
JP 04501768 3/1992
(Continued)

OTHER PUBLICATIONS

Canadian Application No. CA2,877,156, "Office Action", dated Dec. 5, 2019, 3 pages.
(Continued)

*Primary Examiner* — Lore R Jarrett
(74) *Attorney, Agent, or Firm* — Kilpatrick Townsend & Stockton LLP

(57) ABSTRACT

The invention relates to a cartridge housing for forming a cartridge capable of measuring an analyte or property of a liquid sample. The housing including a top portion having a first substantially rigid zone and a substantially flexible zone, a bottom portion separate from the top portion including a second substantially rigid zone, and at least one sensor recess containing a sensor. The top portion and the bottom portion are bonded to form the cartridge having a conduit over at least a portion of the sensor. The invention also relates to methods for forming such cartridges and to various features of such cartridges.

20 Claims, 11 Drawing Sheets

Related U.S. Application Data division of application No. 13/530,501, filed on Jun. 22, 2012, now Pat. No. 9,592,507.

(52) U.S. Cl.
CPC ... *B01L 2200/0689* (2013.01); *B01L 2200/10* (2013.01); *B01L 2200/12* (2013.01); *B01L 2300/043* (2013.01); *B01L 2300/044* (2013.01); *B01L 2300/0636* (2013.01); *B01L 2300/087* (2013.01); *B01L 2300/0887* (2013.01); *B01L 2300/123* (2013.01); *B01L 2400/0487* (2013.01); *Y10T 29/49826* (2015.01); *Y10T 428/13* (2015.01)

(58) Field of Classification Search
CPC ..... B01L 2300/043; B01L 2400/0487; B01L 2300/0636; B01L 2200/0689; B01L 2300/0887; B01L 2200/04; B01L 2300/087; B01L 2300/044; B01L 3/50; Y10T 29/49826; Y10T 428/13; Y10T 156/1051; Y10T 29/4998
See application file for complete search history.

(56) References Cited

U.S. PATENT DOCUMENTS

| | | | | |
|---|---|---|---|---|
| 4,954,087 | A | 9/1990 | Lauks et al. | |
| 5,096,669 | A | 3/1992 | Lauks et al. | |
| 5,200,051 | A | 4/1993 | Cozzette et al. | |
| 5,447,440 | A | 9/1995 | Davis et al. | |
| 5,514,253 | A | 5/1996 | Davis et al. | |
| 5,597,532 | A | 1/1997 | Connolly | |
| 5,821,399 | A | 10/1998 | Zelin | |
| 5,916,522 | A * | 6/1999 | Boyd | B01L 3/502 422/417 |
| 6,030,827 | A | 2/2000 | Davis et al. | |
| 6,033,914 | A | 3/2000 | Boyd et al. | |
| 6,296,796 | B1 | 10/2001 | Gordon | |
| 6,750,053 | B1 | 6/2004 | Widrig Opalsky et al. | |
| 7,213,720 | B2 | 5/2007 | Giraud | |
| 7,263,501 | B2 | 8/2007 | Tirinato et al. | |
| 7,399,628 | B2 * | 7/2008 | Bopp | B01L 3/5025 422/50 |
| 7,419,821 | B2 | 9/2008 | Davis et al. | |
| 7,537,137 | B2 | 5/2009 | Giraud | |
| 8,216,529 | B2 | 7/2012 | Ade et al. | |
| 8,747,774 | B2 | 6/2014 | Doyle et al. | |
| 9,095,791 | B2 | 8/2015 | Prentice et al. | |
| 9,415,389 | B2 | 8/2016 | Doyle et al. | |
| 9,592,507 | B2 | 3/2017 | Doyle et al. | |
| 10,406,523 | B2 | 9/2019 | Doyle et al. | |
| 2003/0156993 | A1 | 8/2003 | Staats | |
| 2003/0170881 | A1 | 9/2003 | Davis et al. | |
| 2005/0054078 | A1 | 3/2005 | Miller et al. | |
| 2006/0002818 | A1 * | 1/2006 | Belz | B01L 3/502 422/400 |
| 2008/0110894 | A1 | 5/2008 | Tissington et al. | |
| 2011/0070132 | A1 * | 3/2011 | Haecker | B01L 3/502707 422/501 |
| 2011/0150705 | A1 * | 6/2011 | Doyle | B01L 3/5055 422/82.02 |
| 2012/0142025 | A1 | 6/2012 | Miller | |
| 2012/0142026 | A1 | 6/2012 | Miller et al. | |
| 2017/0136455 | A1 | 5/2017 | Doyle et al. | |

FOREIGN PATENT DOCUMENTS

| | | |
|---|---|---|
| JP | 2001512826 | 8/2001 |
| JP | 2005519304 | 6/2005 |
| JP | 2006017732 | 1/2006 |
| WO | 2007072009 | 6/2007 |
| WO | 2008030920 | 3/2008 |

OTHER PUBLICATIONS

D638—Standard Test Method for Tensile Properties of Plastics, ASTM International, May 2018, 23 pages.
U.S. Appl. No. 13/530,501, Final Office Action dated Mar. 7, 2016, 17 pages.
U.S. Appl. No. 13/530,501, Non-Final Office Action dated Sep. 12, 2014, 11 pages.
U.S. Appl. No. 13/530,501, Non-Final Office Action dated Mar. 10, 2015, 15 pages.
U.S. Appl. No. 13/530,501, Notice of Allowance dated Nov. 18, 2016, 7 pages.
U.S. Appl. No. 15/419,097, Final Office Action dated Apr. 4, 2019, 8 pages.
U.S. Appl. No. 15/419,097, Non-Final Office Action dated Mar. 22, 2018, 12 pages.
U.S. Appl. No. 15/419,097, Non-Final Office Action dated Sep. 20, 2018, 7 pages.
U.S. Appl. No. 15/419,097, Notice of Allowance dated May 13, 2019, 10 pages.
Chinese Application No. 201380042789.0, Office Action dated Jun. 1, 2016, 13 pages (9 pages of Original Document and 4 pages of English Translation).
Chinese Application No. 201380042789.0, Office Action dated Nov. 5, 2015, 19 pages (11 pages of Original Document and 8 pages of English Translation).
Chinese Application No. 201380042789.0, Office Action dated Oct. 25, 2016, 6 pages (3 pages of Original Document and 3 pages of English Translation).
European Application No. 13734895.9, Office Action dated Oct. 12, 2018, 4 pages.
Japanese Application No. 2015-518543, Office Action dated Jan. 18, 2017, 10 pages (6 pages of Original Document and 4 pages of English Translation).
International Application No. PCT/US2013/046518, International Search Report and Written Opinion dated Nov. 28, 2013, 8 pages.

* cited by examiner

INTEGRATED CARTRIDGE HOUSINGS FOR SAMPLE ANALYSIS

CROSS REFERENCE TO RELATED APPLICATION

This application is a continuation of U.S. patent application Ser. No. 15/419,097, filed on Jan. 30, 2017, which is a divisional application of U.S. patent application Ser. No. 13/530,501, filed on Jun. 22, 2012, which issued as U.S. Pat. No. 9,592,507 on Mar. 14, 2017. The entirety of the foregoing applications is hereby incorporated by reference.

FIELD OF THE INVENTION

The invention relates to medical devices. Specifically, the invention relates to integrated cartridges for performing medical analyses by various assay techniques including immunoassays to determine analyte content or concentration, among other medical analyses and tests.

BACKGROUND OF THE INVENTION

Traditionally, testing of blood or other body fluids for medical evaluation and diagnosis was the exclusive domain of large, well-equipped central laboratories. While such laboratories offer efficient, reliable, and accurate testing of a high volume of fluid samples, they cannot offer rapid turn-around of results to enable more immediate medical decision making. A medical practitioner typically must collect samples, transport them to a laboratory, wait for the samples to be processed and then wait for the results to be communicated. Even in hospital settings, the handling of a sample from the patient's bedside to the hospital laboratory produce significant delays. This problem is compounded by the variable workload and throughput capacity of the laboratory and the compiling and communicating of data.

The introduction of point-of-care blood testing systems enabled practitioners to obtain immediate blood test results while examining a patient, whether in the physician's office, the hospital emergency room, or at the patient's bedside. To be effective, a point-of-care analysis device must provide error-free operation for a wide variety of tests in relatively untrained hands. For optimum effectiveness, a real-time system requires minimum skill to operate, while offering maximum speed for testing, appropriate accuracy and system reliability, as well as cost effective operation.

A notable point-of-care system (The i-STAT® System, Abbott Point of Care Inc., Princeton, N.J.) is disclosed in U.S. Pat. No. 5,096,669, which comprises a disposable device, operating in conjunction with a hand-held analyzer, for performing a variety of measurements on blood or other fluids. The disposable device, reproduced in FIG. 1, is constructed to serve a multiplicity of functions including sample collection and retention, sensor calibration and measurement. In operation, the disposable device is inserted into a hand-held reader or instrument, which provides the electrical connections to the sensors and automatically controls the measurement sequence without operator intervention. The disposable device includes an upper piece 90 and a lower plastic piece 12 in which are mounted a plurality of sensors 66 with electrical contacts and a pouch 60 containing a sensor-standardization or calibrant fluid. The sensors generate electric signals based on the concentration of specific chemical species in the fluid sample. A double-sided adhesive sheet 74 is situated between the upper piece 90 and the lower piece 12 to bond them together and to define and seal several cavities and conduits within the device.

In the '669 disclosure, a cavity 18 is located at the center of the device having a sealed pouch 60 containing calibrant fluid. A first conduit 24 leads from this cavity 18 toward the sensors 66. A second conduit 92 has an orifice at one end for the receipt of a sample while the other end of the tube terminates at a capillary break 96. A third conduit 94 leads from the capillary break 96 across the sensors 66 to a second cavity 20, which serves as a sink. The first conduit 24 joins the third conduit 94 after the capillary break 96 and before the sensors 66. A third cavity 22 functions as an air bladder. When the air bladder is actuated, the air is forced down a fourth conduit (see FIG. 2 of the '669 patent) and into the second conduit 92.

In operation, a fluid sample is drawn into the second conduit 92 by capillary action by putting the orifice at one end of the second conduit in contact with the sample. After the sample fills the second conduit, the orifice is sealed off. The pouch 60 containing the calibrant fluid is then pierced and the calibrant fluid flows from the cavity through the first conduit 24 to the third conduit 94 and across the sensors 66 at which time sensor calibration is performed. Next, the air bladder is actuated by the instrument forcing air down the fourth conduit to one end of the second conduit 92 which forces the sample out of the other end of the conduit, past a capillary break 96, and into the third conduit 94 and across the sensors 66 where measurements are performed. As this is done, the calibration fluid is forced out the third conduit 94 into the second cavity 20 where it is held. Once the measurements are made, the disposable device can be discarded.

The hand-held reader includes an opening in which the disposable device is received. After the disposable device is inserted into the reader, the reader engages the electrical contacts on the disposable device, ruptures the pouch, calibrates the sensors, actuates the air bladder to force the fluid sample across the sensors, records the electric signals produced by the sensors, calculates the concentration of the chemical species tested, and displays the information. Upon completion of the process, the user removes the device from the reader and simply disposes of it. The reader is then ready to perform another measurement, which is initiated by the insertion of another disposable device. Note that alternative cartridge fluidic systems that permit performing immunoassays and coagulation measurements using similar instrument format are described in jointly owned U.S. Pat. Nos. 7,419,821, 6,750,053 and 5,447,440, all of which are incorporated herein by reference in their entireties.

While use of the '669 invention, described above, is particularly advantageous in the point-of-care medical environment, there remains a need for single-use blood testing devices that are simpler to manufacture, assemble and use.

SUMMARY OF THE INVENTION

The present invention, in one embodiment, is directed to a cartridge housing for forming a cartridge capable of measuring an analyte or property of a liquid sample. The cartridge housing comprises a top portion having a first substantially rigid zone and a substantially flexible zone. The cartridge housing further comprises a bottom portion separate from the top portion including a second substantially rigid zone. The cartridge further comprises at least one sensor recess containing a sensor. The top portion and the bottom portion are bonded to form the cartridge having a conduit over at least a portion of the sensor.

In addition, the cartridge housing may comprise a gasket that is situated between the top portion and the bottom portion to form the cartridge. The gasket bonds the top portion and the bottom portion together, and defines and seals the conduit. The gasket covers substantially an entire area between the top portion and the bottom portion of the housing. In one embodiment, the gasket is a double-sided adhesive sheet that forms a liquid-tight seal.

In another embodiment, the invention is directed to a method of making a test cartridge for measuring an analyte or property of a liquid sample. The method comprises molding a housing comprising (i) a top portion including a first substantially rigid zone and a substantially flexible zone, and (ii) a bottom portion including a second substantially rigid zone. The second substantially rigid zone comprises at least one sensor recess. The method further comprises inserting a sensor into the sensor recess, abutting the top portion with the bottom portion, and sealing the housing in a closed position. The sealing forms the cartridge, and the cartridge comprises a conduit over at least a portion of the sensor.

In addition, the method may comprise inserting a gasket between the top portion and the second portion before sealing the housing in a closed position. The gasket covers substantially an entire area between the top portion and the bottom portion of the housing. In one embodiment, the gasket is a double-sided adhesive sheet that forms a liquid-tight seal.

In another embodiment, the invention is directed to a sample analysis cartridge. The sample analysis cartridge comprises a housing having separate opposing housing portions comprising (i) a top portion including a first substantially rigid zone and a substantially flexible zone, and (ii) a bottom portion including a second substantially rigid zone. The cartridge further comprises a sample entry orifice for receiving a fluid sample and a holding chamber disposed between the sample entry orifice and a capillary stop for forming a metered sample therebetween. The capillary stop is formed of the opposing housing portions and the substantially flexible portion disposed therebetween to seal the opposing housing portions in a liquid-tight manner. The cartridge further comprises a conduit disposed between the capillary stop and a sensor and being configured to deliver the metered sample from the capillary stop to the sensor and a gasket configured to bond at least a portion of the top portion and a portion of the bottom portion together.

In addition, the sample analysis cartridge may comprise a ramped region in which the lateral cross-sectional area decreases in a distal direction from the sample entry orifice to the capillary stop. In one embodiment, the side walls of the holding chamber narrow at the capillary stop.

In another embodiment, the invention is directed to a cartridge capable of measuring an analyte or property of a liquid sample. The cartridge comprises a sample entry orifice for receiving the liquid sample and a top housing portion defining a top portion of a conduit. The cartridge further comprises a bottom housing portion defining a bottom portion of the conduit. The top portion and the bottom portion are sealed together with one or more mating elements to form the conduit and at least one of the top portion or the bottom portion includes a flexible sealing ridge for sealing opposing portions of the conduit. The cartridge further comprises a sensor for detecting the analyte or property of the liquid sample.

In yet another embodiment, the invention is directed to a molded housing that comprises a substantially rigid zone, a substantially flexible zone, and a gasket. The housing is bonded together with the gasket to form a fluid channel and at least a portion of the gasket forms a channel seal.

In yet another embodiment, the invention is directed to a cartridge that comprises separate top and bottom portions, at least one of which comprises a substantially rigid zone and a substantially flexible zone. The portions are bonded together to form a fluid channel, and at least a portion of the substantially flexible zone forms a channel seal.

In yet another embodiment, the invention is directed to a method for forming a cartridge. The method comprises providing a molded housing having two separate portions, at least one of which comprises a substantially rigid zone and a substantially flexible zone. The method further comprises providing a gasket between the two separate portions and bonding the two portions using the gasket to form a fluid channel. At least a portion of the gasket forms a channel seal.

In yet another embodiment, the invention is directed to a method for forming a cartridge. The method comprises providing a molded housing comprising two separate portions, at least one of which comprises a substantially rigid zone and a substantially flexible zone. The method further comprises bonding the two portions to form a fluid channel. At least a portion of the substantially flexible zone forms a channel seal.

BRIEF DESCRIPTION OF THE DRAWINGS

The present invention will be better understood in view of the appended non-limiting figures, in which.

DETAILED DESCRIPTION OF THE PREFERRED EMBODIMENTS

Immunoassay Cartridges

Figure 1:
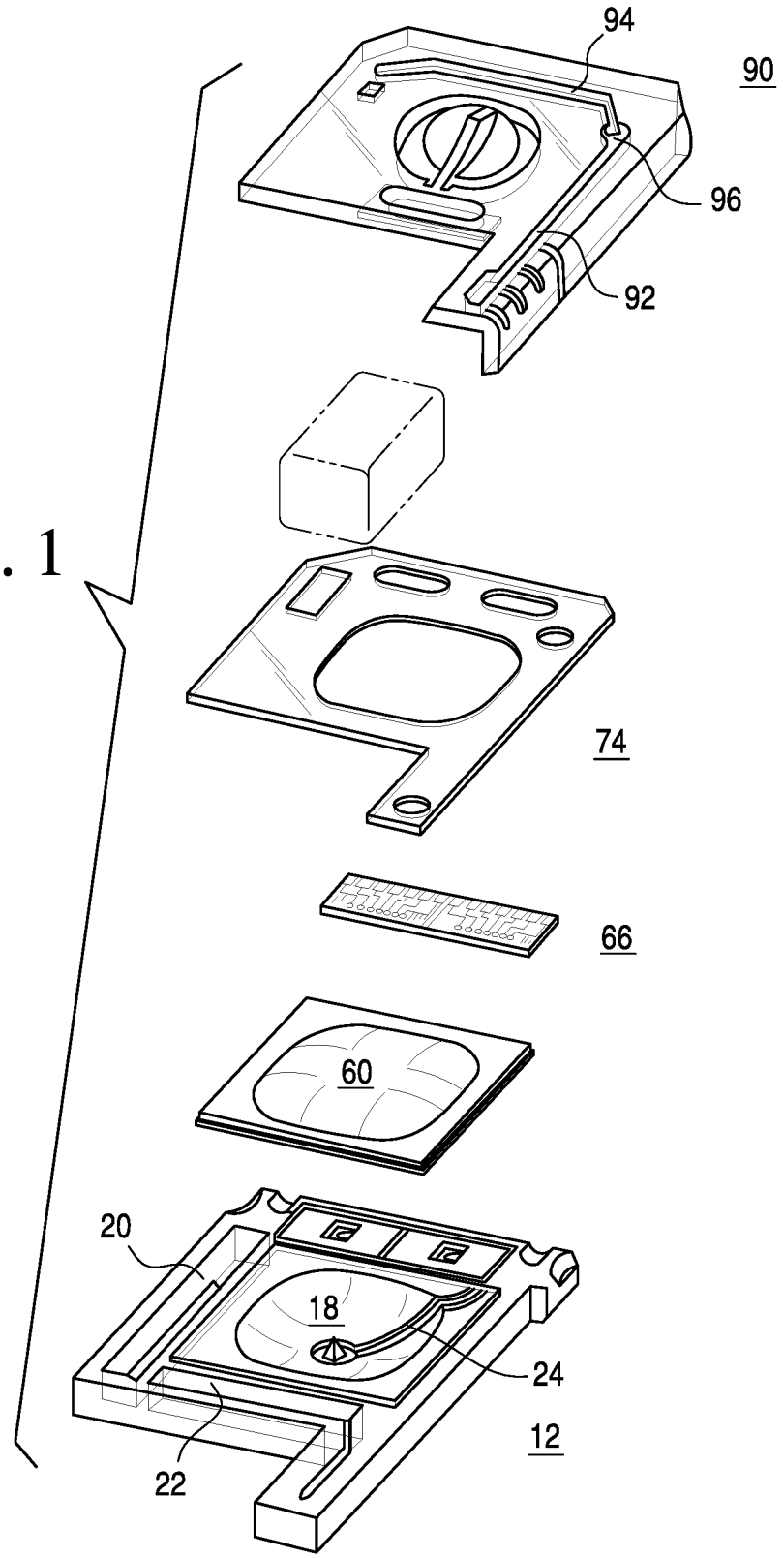
FIG. 1 is an exploded view of the disposable device disclosed in U.S. Pat. No. 5,096,669.
Figure 2:
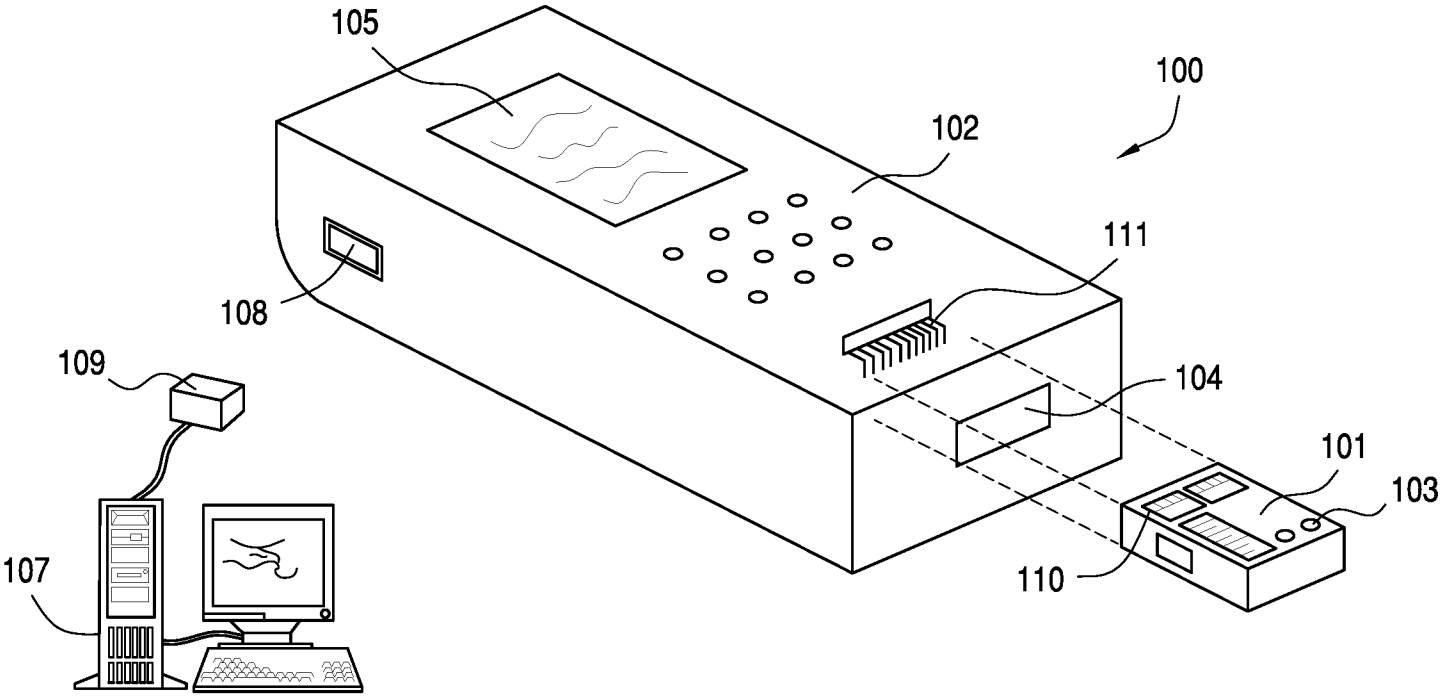
FIG. 2 is an isometric view of a disposable sensing device and reader according to one embodiment of the invention.

Referring to FIG. 2, the system 100 of the present invention comprises a self-contained disposable sensing device or cartridge 101 and a reader or instrument 102. A fluid sample to be measured is drawn into a sample entry orifice or port 103 in the device and the device is inserted into the reader through a slotted opening 104. Measurements performed by the reader are output to a display 105 or other output device, such as a printer or data management system 107 via a port on the reader 108 to a computer port 109. Transmission can be via Wifi, Bluetooth link, infrared and the like. Note that where the sensors are based on electrochemical principles of operation, the sensors 110 in the cartridge 101 make electrical contact with the instrument 102 via an electrical connector 111. For example, the connector may be of the design disclosed in jointly owned U.S. Pat. No. 4,954,087, incorporated herein by reference in its entirety. The instrument 102 may also include a method for automatic fluid flow compensation in the cartridge 101, as disclosed in jointly owned U.S. Pat. No. 5,821,399, which also is incorporated herein by reference in its entirety.

The present invention is best viewed as an improvement over a blood testing cartridge based on two separate plastic parts (a base and cover) held together by double-sided adhesive. See, e.g., U.S. Pat. Nos. 5,096,669 and 7,419,821, both of which are incorporated herein by reference in their entireties. In contrast to the devices described in '669 and '821 patent disclosures, however, the present invention is based on devices having two separate plastic parts (a base and a cover) made of two different materials, preferably formed in a two-shot molding process. In one embodiment, the two separate plastic parts may be made of the same material, e.g., Polyethylene Terephthalate Glycol-modified (PETG). The two separate plastic parts are bonded in a closed position to form a cartridge. In a preferred embodiment, the two separate plastic parts are held together by a double-sided adhesive. Cartridges having substantially rigid and flexible sections are described in commonly owned US20110150705A1. The cartridge described in the '705 application is of unitary construction with a hinge connecting top and bottom portions. In contrast, the cover/top and base/bottom portions of the present invention are preferably not connected together with a hinge, allowing for use of a separate gasket for small features that are more difficult to render using a thermoplastic molded feature while retaining the integrated molded displaceable pump membrane and molded sealing element at the blood port.

Figure 3A:
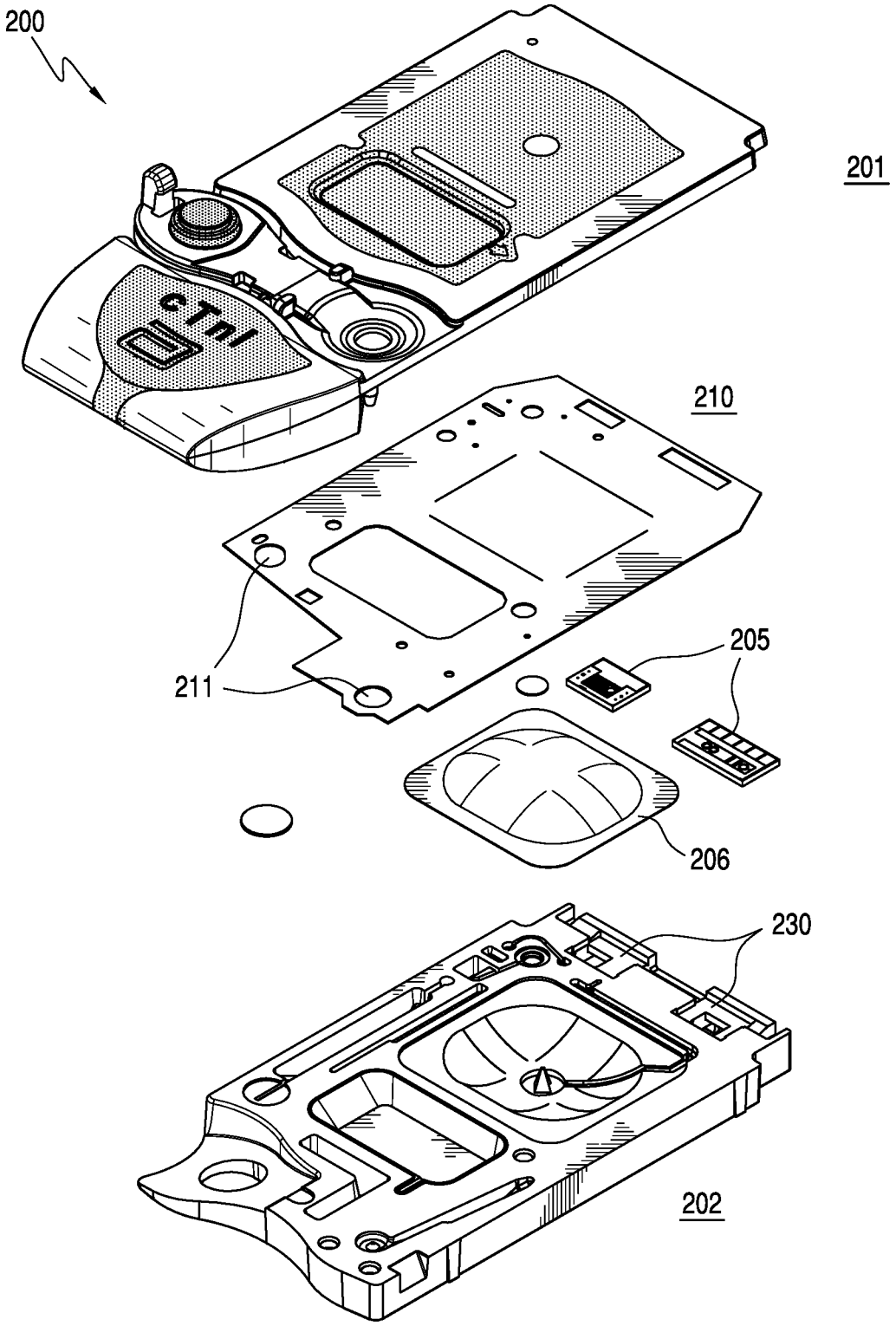
FIGS. 3A and 3B are exploded views of a cartridge according to one embodiment of the invention.

As shown in FIG. 3A, the cartridge 200 comprises a top portion 201 (e.g., a cover) and a bottom portion 202 (e.g., a base) in which are mounted at least one sensor 205 with electrical contacts and a pouch 206 containing a fluid, e.g., a sensor-standardization or calibrant fluid. The at least one sensor 205 generates electric signals based on a concentration of specific chemical species in a fluid sample, e.g., a blood sample from a patient. A double-sided adhesive sheet 210 or gasket material is situated between the cover 201 and the base 202 to bond them together and to define and seal several cavities and conduits within the device.

Figure 3B:
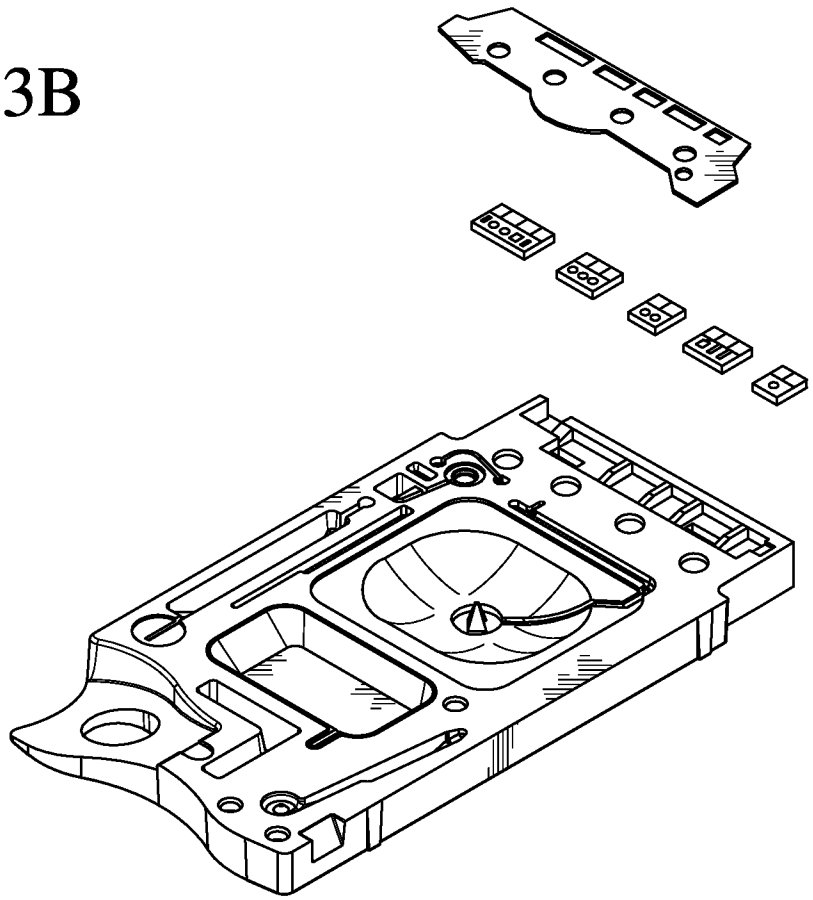
Figure 4D:
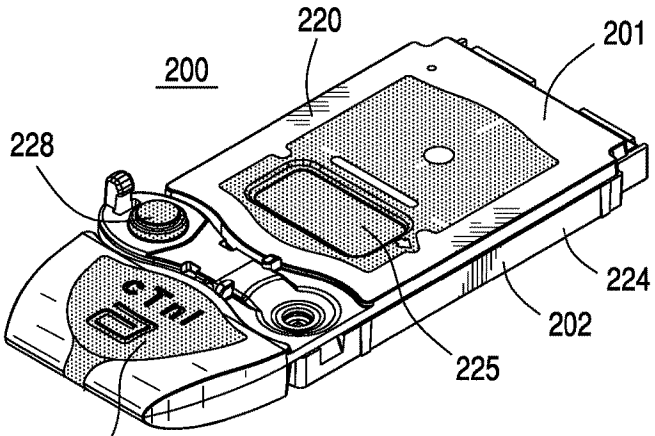
FIGS. 4A-4E are top, bottom, side, and perspective views of the cartridge in the closed position according to one embodiment of the invention.
Figure 4E:
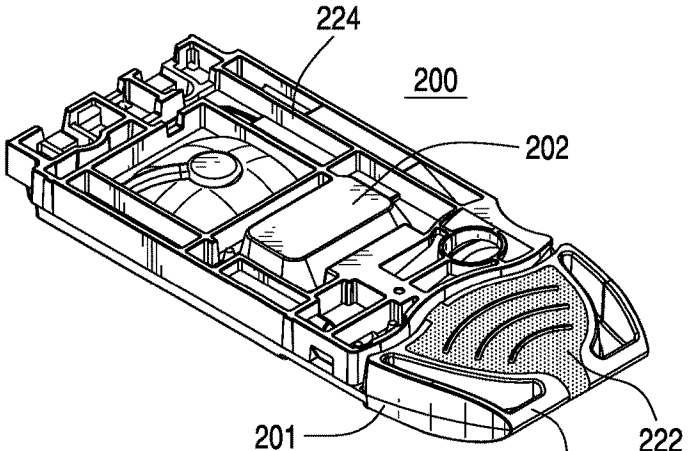
Figure 4B:
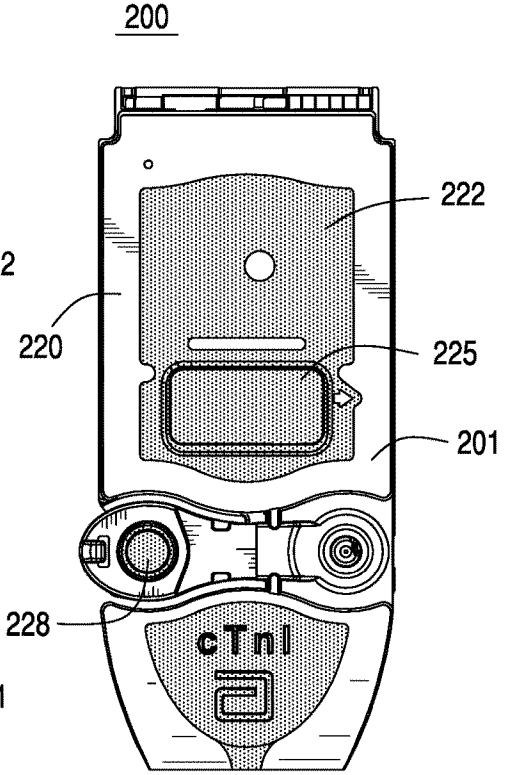
Figure 4C:
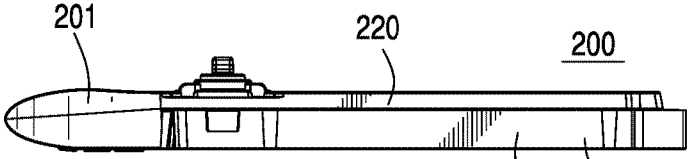
Figure 4A:
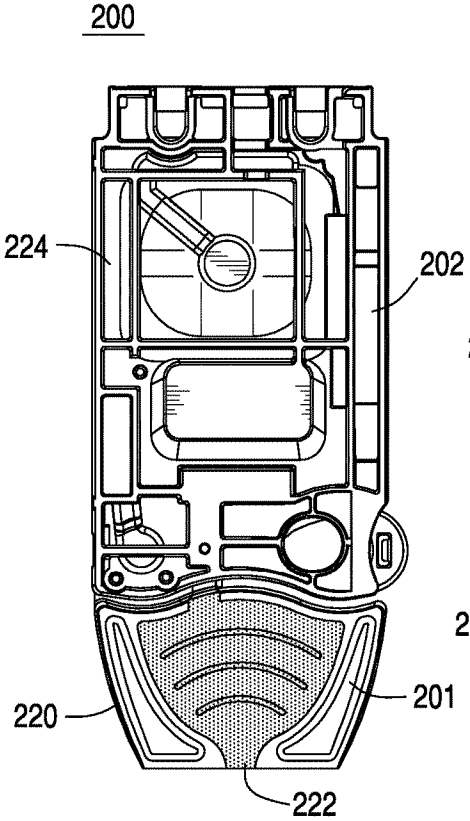

The double-sided adhesive sheet 210 or gasket forms a liquid-tight and/or air-tight seal and may be formed from a standard tape material, e.g. polyester, distinguished in that adhesive material is applied to both sides of the tape. The double-sided adhesive sheet is generally manufactured on a roll and the features (holes) cut into the tape are formed by either a cutting dye or laser. A portion or portions of double-sided adhesive sheet 210 may be formed of a thermoplastic elastomer (TPE) in a molding step, or alternatively by a bead of glue, a perimeter of formable resin, e.g., epoxy, a dielectric grease or a peripheral sealing ridge formed of the substantially flexible material. In a preferred embodiment, the complete tape gasket 210 is employed. The gasket may cover substantially the entire area between the cover 201 and the base 202 of the cartridge 200, as shown in FIG. 3A, or may be localized over and between only predetermined structural features, e.g., the at least one sensor 205, of the cartridge 200, as shown in FIG. 3B. The gasket may include apertures 211 to enable physical, fluidic and/or gaseous communication between structural features of the cover 201 and the base 202. The gasket may or may not have an adhesive surface, and may have an adhesive surface on both sides thereof, i.e., forming a double-sided adhesive layer.

In an alternative embodiment, a peripheral sealing ridge of the molded substantially flexible zone may be used as a gasket to form one or more conduits when matted against a complimentary substantially rigid zone or portion of the housing. An advantage of this alternative embodiment is that the use of the substantially flexible zone as the gasket substantially simplifies manufacture by partially or entirely eliminating a component, i.e., the double-sided adhesive sheet 210.

Figure 5:
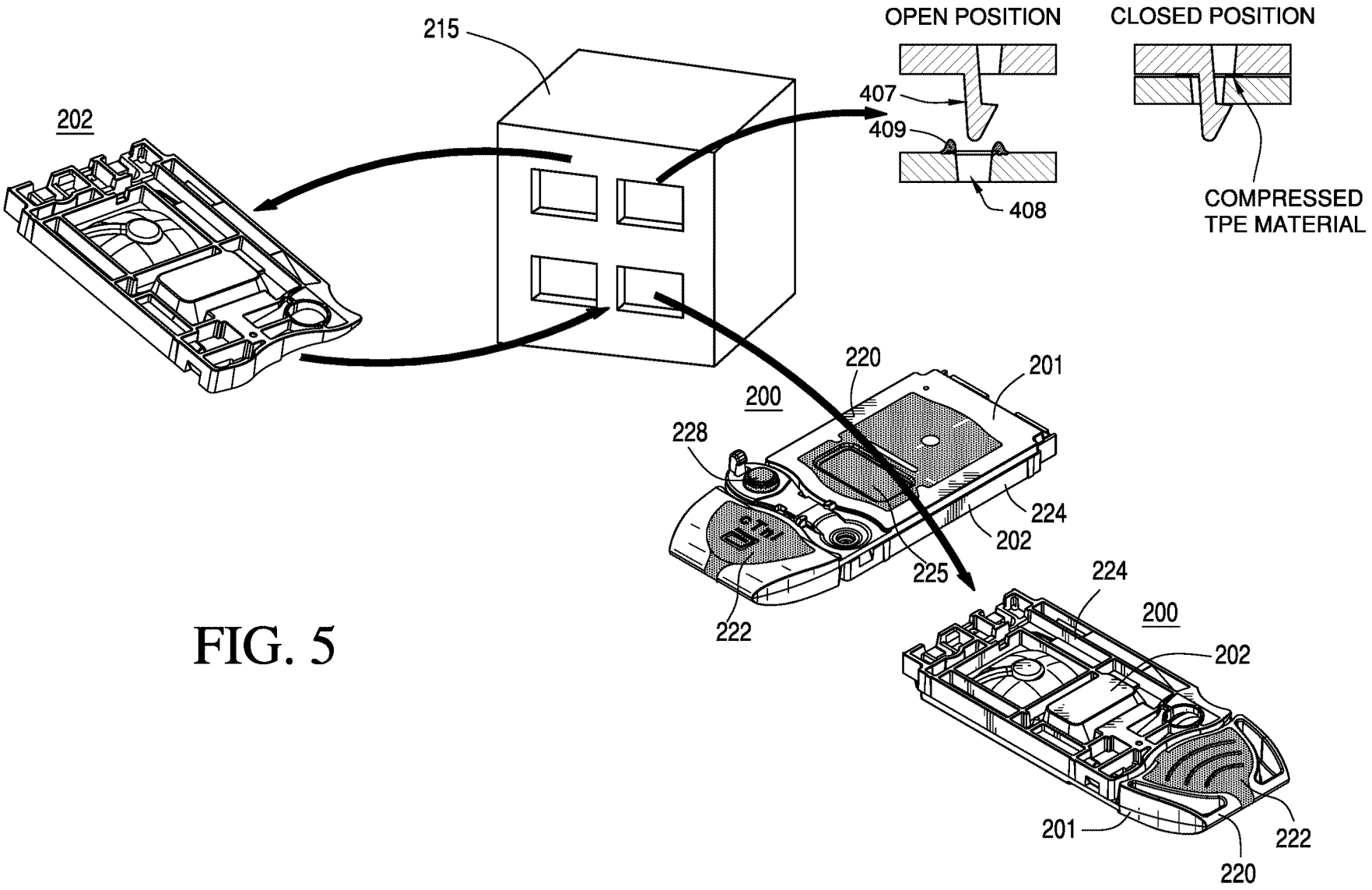
FIG. 5 provides perspective views of cartridges in various stages of construction according to one embodiment of the invention.

As shown in FIGS. 4A-4E, the cartridge 200 includes a housing that comprises two complimentary halves of a cartridge (e.g., the cover 201 and the base 202), which can be bonded together to abut and attach the two complimentary interior surfaces of the two halves in a closed position. As illustrated in FIG. 5, the cover 201 and the base 202 are preferably injection molded, for example, by machine 215, as discussed in further detail below. Preferably, the cover 201 is injection molded where a first substantially rigid zone 220 is formed in a first injection molding step and a substantially flexible zone 222 is formed in an additional injection molding step. Preferably, the base 202 is injection molded where a second substantially rigid zone 224 is formed in a first injection molding step. While the above-described embodiment has been described comprising a cover formed using a two-shot molding process and a base formed using a one-shot molding process, it should be understood that the cover could be formed using a one-shot molding process and the base formed using a two shot molding process, or both the cover and the base could be formed using a two-shot molding process depending on where the substantially rigid zone and the substantially flexible zones are to be located within the housing of the cartridge.

As shown in FIGS. 4A-4E and 5, the substantially rigid zones 220 and 224 of the cover 201 and the base 202 respectively are preferably each a single contiguous zone; however, the molding process can provide a plurality of non-contiguous substantially rigid zones. The substantially flexible zone 222 is preferably a set of several non-contiguous zones. For example, the substantially flexible zone 222 around a displaceable membrane 225 may be separate and distinct from the substantially flexible zone at a closeable sealing member 228. Alternatively, the substantially flexible zone may comprise a single contiguous zone.

In an embodiment, the cartridge housing comprises a sensor recess 230 in a portion of the substantially flexible zone. An advantage is that the sensor 205 (preferably of a size of about 0.3×0.4 cm), which is disposed in the sensor recess 230 preferably is made on a silicon wafer substrate, which is relatively brittle. Thus, providing a substantially flexible sensor recess 230 results in a suitable support that can protect the sensor from cracking during assembly. Note that other non-silicon based sensors may be used, e.g., those made on a plastic substrate; however, the preferred embodiment uses sensors of the type described in U.S. Pat. Nos. 5,200,051; 5,514,253 and 6,030,827, the entireties of which are incorporated herein by reference. In addition to being substantially flexible, sensor recess 230 is best selected to form a liquid-tight and/or air-tight seal around the sensor perimeter, thereby ensuring that liquids do not leak out of the conduit that covers the sensor in the fully assembled cartridge. In an alternative embodiment, sensor recess 230 can be formed in a portion of the substantially rigid zone (as shown in FIG. 3A) of either or both of the cover or the bottom of the housing. In this aspect, a liquid-tight and/or air-tight seal optionally may be formed by the double-sided adhesive sheet 210 or gasket.

With regard to overall dimensions, the preferred embodiment of the molded parts shown in FIGS. 4A-4E and 5 include the cover 201 with dimensions of about 6.0 cm×3.0 cm×0.2 mm and the base 202 with dimensions of about 5.0 cm×3.0 cm×0.2 mm to provide a cartridge 200 with dimensions of about 6.0 cm×3.0 cm×0.4 cm. In terms of ranges, the cartridge 200 optionally has a length of from 1 to 50 cm, e.g., from 5 to 15 cm, a width of from 0.5 to 15 cm, e.g., from 1 to 6 cm, and a thickness of from 0.1 to 2 cm, e.g., from 0.1 to 1 cm.

While the present invention is mainly described in terms of a cartridge that includes a sensor, the method of using a housing based on a combination of substantially rigid and substantially flexible materials is more broadly applicable to diagnostic and monitoring devices. For example, one or more portions of the substantially rigid zones may be made of an optically transparent plastic to permit light generated by an assay reaction to reach a detector included in the reader device. Alternatively, opposing portions of the substantially rigid zones may form a "cuvette" in the channel, where the reader measures absorbance at one or more wavelength in the cuvette. Note that the height (or path-length) of the cuvette and its reproducibility from device-to-device, may be controlled by the repeatable molding process, the use of staking elements of defined height and the degree of deformability of the substantially flexible material. For example, two substantially rigid zones may be abutted during bonding and staked, with adjacent portions of the substantially flexible material forming a seal. Optical assays may include, for example, metabolite assays, e.g., glucose and creatinine, immunoassays, e.g., troponin and B-type natriuretic peptide (BNP), and nucleotide assays, e.g., DNA, ssDNA, mRNA. Optical assay principles may include fluorescence, luminescence, absorbance and emission.

Figure 6A:
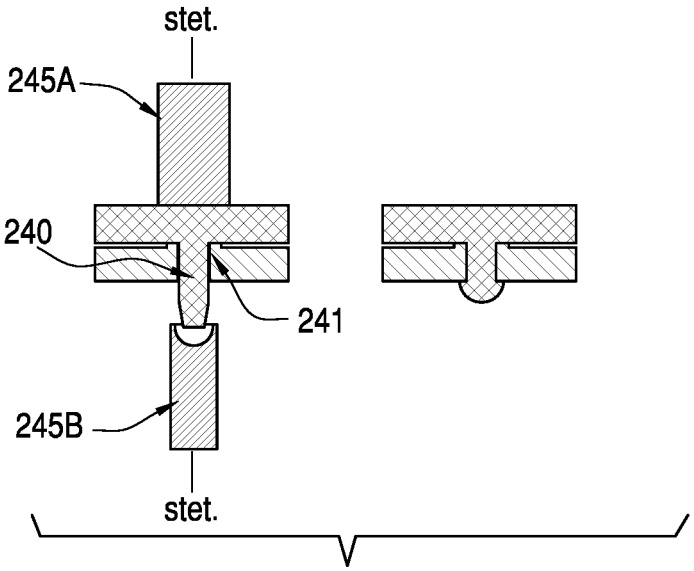
FIGS. 6A-6C illustrate three optional closure mechanisms that may be employed to seal the cartridge in a closed position.
Figure 6B:
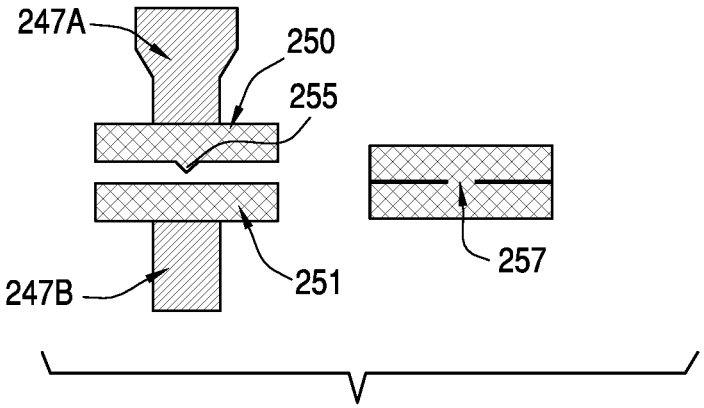
Figure 6C:
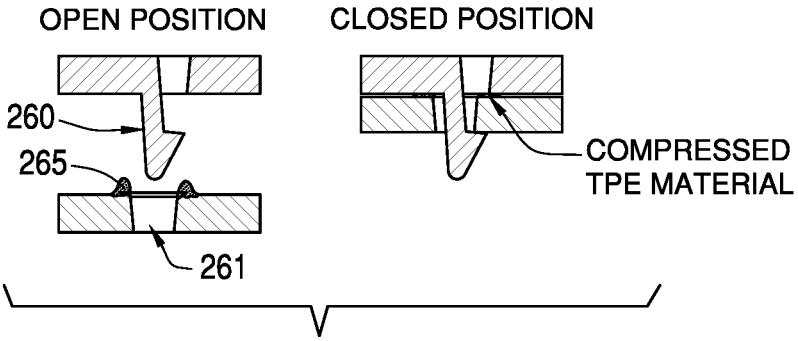

As shown in FIGS. 6A-6C, to attach together or bond the complimentary interior surfaces of the two halves, the housing preferably includes one or more mating elements, e.g., a male piece and a female piece, on either or both halves, whereby abutting the two complimentary interior surfaces in a closed position engages the mating elements in a secure manner. Alternatively, symmetrically matched parts may be used. Preferably, the mating of the mating elements causes the opposing halves of one or more conduits of the cartridge to be fluidically sealed such that fluid passing through the one or more conduits will be constrained and flow along the path of the conduit. In a preferred embodiment, the cartridge comprises a primary conduit beginning at a sample entry orifice and including a sample holding chamber between the sample entry orifice and a capillary stop for forming a metered sample. The conduit also includes a sensing region comprising one or more sensors and in which the sample is analyzed. The conduit optionally further comprises a waste chamber.

The form in which the mating elements may be joined together may vary widely. In a preferred embodiment, shown in FIGS. 6A 7A, 7C, 8A, and 8D, each mating element comprises a prong 240 and a corresponding alignment hole 241. Note that where double-sided adhesive tape is used as the gasket across substantially all of the mating area, the adhesive can be sufficient alone to hold the two components together, thus the primary function of the mating elements is to align the formed structure correctly. Each alignment hole 241 preferably is aligned with a prong 240 such that the prong 240 is inserted into the hole 241 upon closure of the cartridge housing, i.e., upon abutting of the two halves. Depending on the desired design, each prong/alignment hole pair may fit loosely (for example if the prong will be subsequently secured as a rivet) or may be interference fit. The prongs may be on either side, e.g., top or bottom portions, of the device. Once the prong 240 from one side of the cartridge housing is inserted into the corresponding alignment hole 241 in the opposite side of the cartridge housing, the mating elements may be joined together using an anvil 245A and riveting pin 245B. The riveting pin 245B preferably comprises a concave head, as shown in FIG. 6A, and is capable of deforming the prong 240 to form a rivet and securing the two halves to one another. In a hot-staking process, the riveting pin 245B may be heated, for example, to at least the deflection temperature of the composition that forms the prong 240. In a preferred aspect, an automated folding machine is used to act as the anvil 245A to apply a force that is transferred to a heated riveting pin 245B. This softens and deforms the end of the prong 240 to form a rivet having a curved outer profile, as shown.

Alternatively, in a cold-staking process, the riveting pin 245A may comprise a machined cold-staking element, which deforms the prong 240 under pressure, but without heating (or with minimal heating resulting from the application of pressure). The cold staking process is substantially the same as that for the hot-staking process, with the omission of heating. In this aspect, either the anvil 245A or the riveting pin 245B optionally is stationary during the riveting process.

The staking process preferably slightly compresses the double-sided adhesive sheet or gasket, e.g., thermoplastic elastomers and/or the substantially flexible material, uniformly across the cartridge body providing an even seal throughout and forming one or more liquid tight conduits. To achieve this, the staking pegs ideally are spaced to achieve a substantially uniform tension in the seal area. To accommodate the required fluid conduit geometry, finite element analysis may be used to determine the number of staking pegs and their positions. This analysis predicts the distortion of the rigid polymer caused by the compression of the double-sided adhesive sheet or gasket. The distortion of the substantially rigid material should be less than the intended compression of the double-sided adhesive sheet or gasket to ensure formation of a proper seal. The height and section of the double-sided adhesive sheet or gasket can be changed locally to compensate for substantially rigid material distortion in order to maintain a desired seal. The compression of the double-sided adhesive sheet or gasket in a cartridge preferably is from 0.0005 to 0.050 inches (12 μm to 1270 μm), e.g., from about 0.001 to 0.010 inches (25 to 254 μm), or preferably about 0.005 inches (about 127 μm). Hardstops may be included in the design of the staking pegs and bosses to ensure compression is no greater than the desired amount, e.g., about 0.005 inches (127 μm).

In another aspect, the mating elements may be joined by ultrasonic welding. For example, the housing may comprise one or more welding regions on either or both halves, whereby abutting the complimentary halves engages complimentary welding regions. That is, abutting engages the welding regions so that they are configured such that they may be welded together in a secure manner to form the conduit. The engaged complimentary welding regions then may be welded to one another in a welding step to secure them together. Each riveting pin 245B, for example, may comprise an ultrasonic horn. In this aspect, the anvil 245A preferably aligns with the ultrasonic horn 245B (riveting pin), with the cartridge in between and positioned adjacent to the prong 240 and the hole 241. Application of ultrasonic energy by the ultrasonic horn causes the corresponding prong to deform, thereby forming a rivet to secure the two halves together.

In another embodiment, shown in FIG. 6B, the anvil 247A and horn 247B align a first piece of the housing 250 and a second piece of the housing 251 when in the closed position. Between the two pieces of housing is a joining bond 255, which, as shown, is a small area of plastic standing proud of the first piece of the housing 250. Application of ultrasonic energy provides a weld 257, as shown. In various optional embodiments, the welding may comprise ultrasonic, laser or thermal welding.

FIG. 6C illustrates a snap closure where one side (top or bottom) of the housing includes one or more hooks 260 which align and penetrate a corresponding hook hole 261 on the other side (bottom or top) of the housing during bonding and are thereby secured to one another, as shown in going from the open to the closed position. Optionally, TPE material 265 may surround the inner surface of the hook hole 261, as shown, in order to provide an additional sealing function. Additionally or alternatively, an elastomeric TPE material may surround the one or more hooks 260.

In another embodiment, the housing comprises one or more gluable mating elements on either or both halves. Abutting of the complimentary halves engages the mating elements in a secure manner after glue is applied to one or both halves of the mating element. As described above, this embodiment forms the cartridge having the desired conduit network.

Figure 7C:
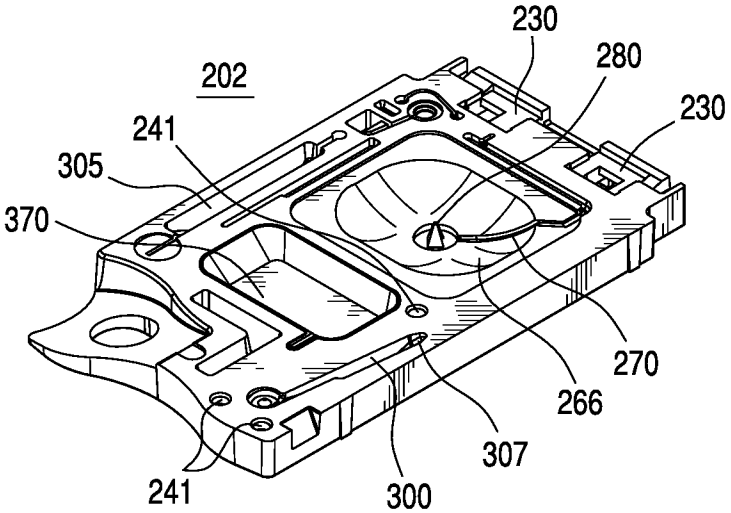
FIGS. 7A-7E are top, bottom, side, and perspective views of a bottom portion of the cartridge according to one embodiment of the invention.
Figure 7D:
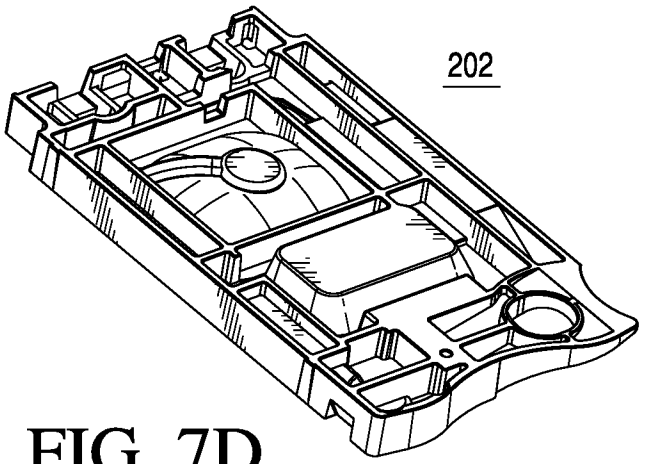
Figure 7A:
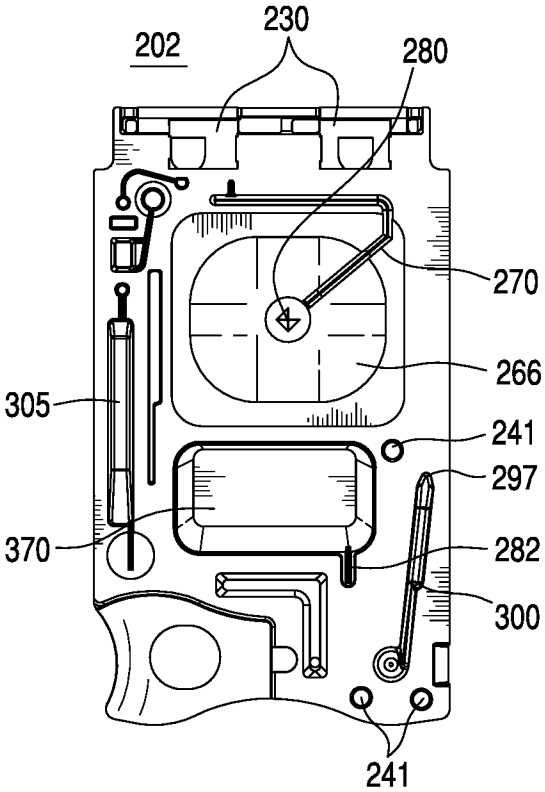
Figure 7E:
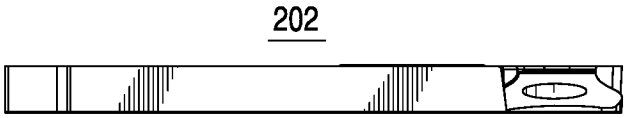
Figure 7B:
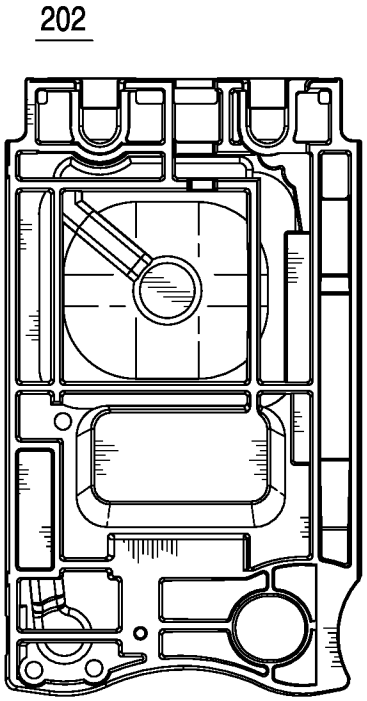

Reverting to FIG. 3, in a preferred embodiment, the cartridge 200 comprises the sealed pouch 206 containing a fluid. Generally, the composition of the fluid in the pouch 206 may be selected from the group consisting of water, calibrant fluid, reagent fluid, control fluid, wash fluid and combinations thereof. As shown in FIGS. 7A and 8A, the pouch 206 is disposed in a recessed region 266 and in fluid communication with a conduit 270 leading to the sensor recess 230, optionally via conduit 275. The pouch 206 may be of the design described in U.S. Pat. No. 5,096,669 or, more preferably, in U.S. patent application Ser. No. 12/211,095, both of which are incorporated herein by reference in their entireties. Recessed region 266 preferably includes a spike 280 configured to rupture the pouch 206, upon application of a force upon the pouch 206, for example, by reader or instrument 102 (FIG. 2). Once the pouch 206 is ruptured, the system is configured to deliver the fluid contents from the pouch 206 into conduit 270. Movement of the fluid into the conduit 270 and to the sensor region 230 and/or within the conduit 275 may be effected by a pump, e.g., a pneumatic pump connected to the conduit 275. Preferably, the pneumatic pump comprises the displaceable membrane 225 formed by a portion of the substantially flexible zone 222 of the housing. In the embodiment shown in FIGS. 7A-7E and 8A-8E, upon repeatedly depressing the displaceable membrane 225, the device pumps via conduits 275, 282, 283, and 284 causing fluid from ruptured pouch 206 to flow through the conduit 270, into the conduit 275 and over the sensor region 230.

Figure 8C:
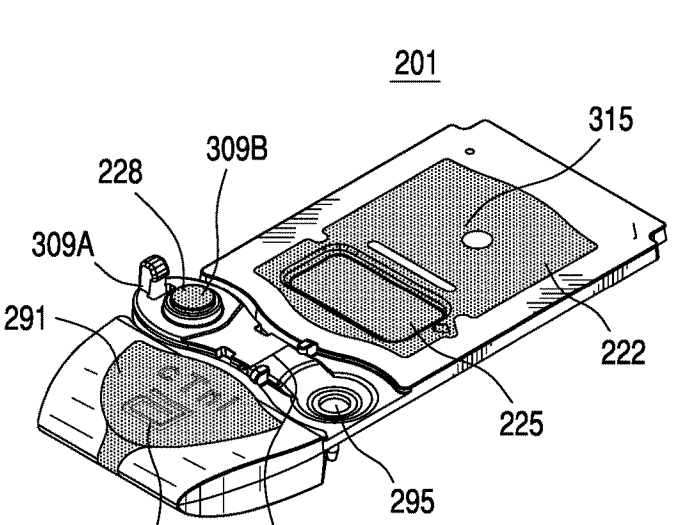
FIGS. 8A-8E are top, bottom, side, and perspective views of a top portion of the cartridge according to one embodiment of the invention.
Figure 8D:
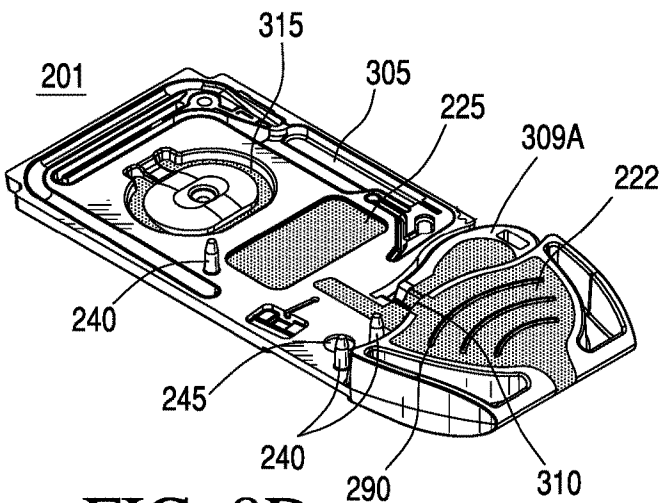
Figure 8B:
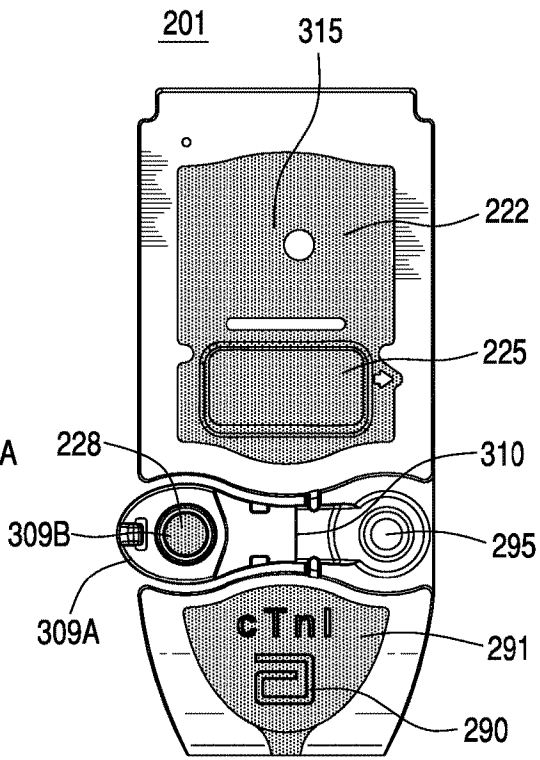
Figure 8A:
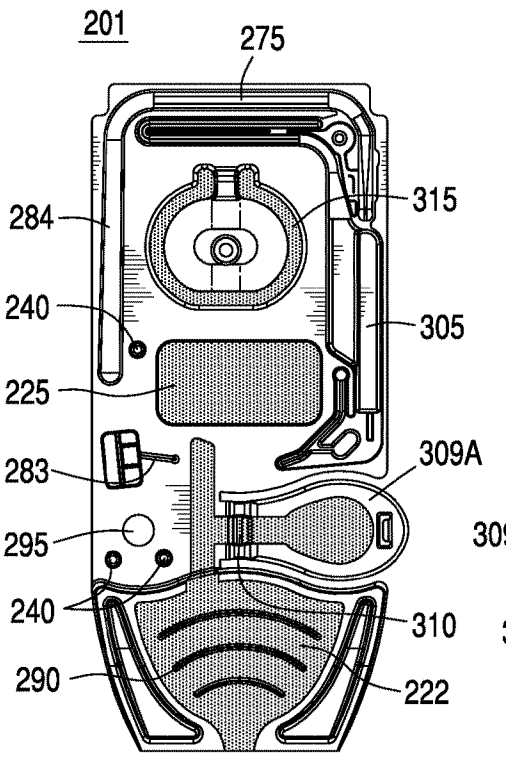
Figure 8E:
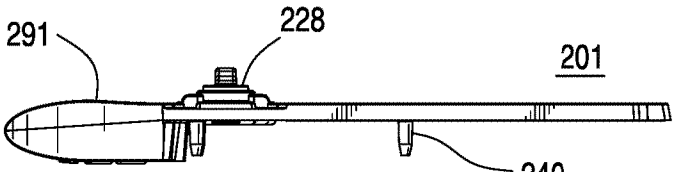

As shown in FIGS. 8A-8E, the cartridge may include one or more features 290 on the top and/or bottom of the cartridge to prevent slippage while being filled by the user. These features 290 could be made of the substantially rigid material or the substantially flexible material; alternatively, they could be formed of both materials. These features could for example include ribs, studs or a textured surface. The features could be concentrated locally on the underside (e.g., beneath the thumb grip) or could be spaced across the whole underside. As shown in FIGS. 8B, 8C and 8E, in a preferred embodiment, a portion of the substantially flexible zone 222 forms an ergonomic thumb well 291. The thumb well 291 assists the user in handling the cartridge, e.g., holding the cartridge during the sample filling step and in engaging the cartridge with the reading instrument 102 (shown in FIG. 2).

Figure 9A:
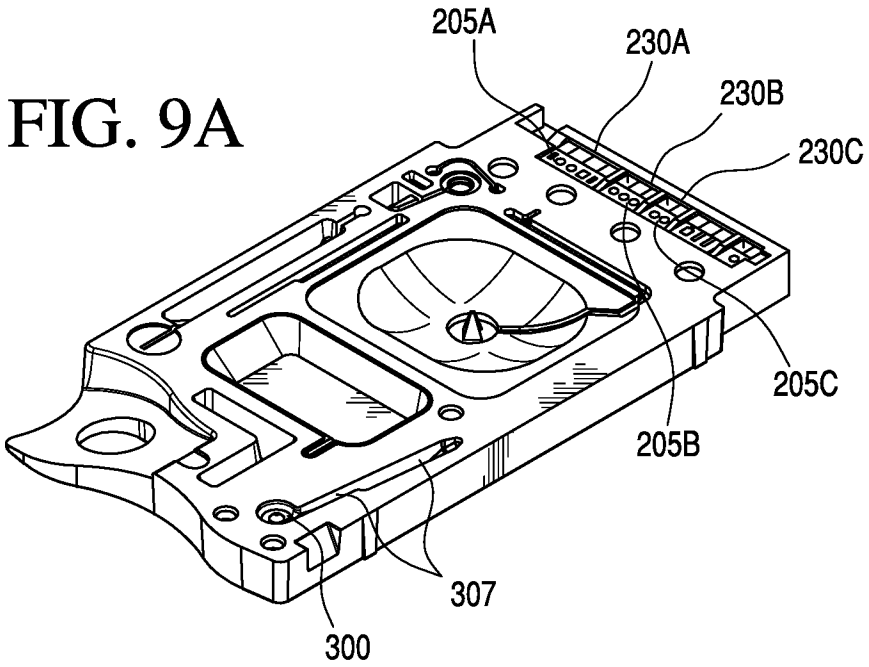
FIG. 9A provides a perspective view of the a sensor region of the cartridge according to one embodiment of the invention.
Figure 9B:
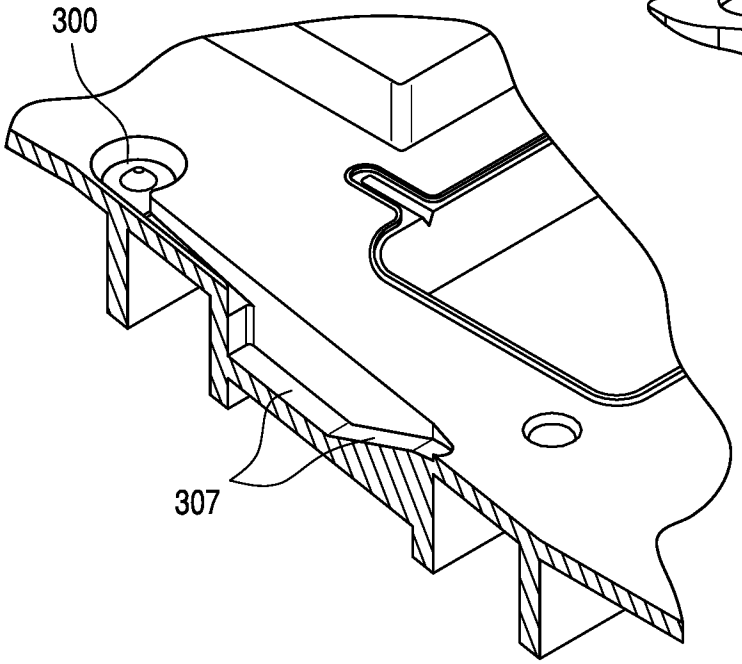
FIG. 9B is a magnified perspective view of the sample entry orifice and holding chamber region of the cartridge according to one embodiment of the invention.

As shown in FIGS. 7A-7E and 8A-8E, in a preferred embodiment, the cartridge comprises a sealable sample entry port 295, the closable sealing member 228 for closing the sample entry port 295, a sample holding chamber 300 located downstream of the sample entry port 295, a capillary stop 297, the sensor region 230, and a waste chamber 305 located downstream of the sensor region 230. Preferably, the cross-sectional area of a portion of the sample holding chamber 300 decreases distally with respect to the sample entry port 295, as shown by ramp 307 in FIGS. 7C and 9B. FIG. 9B shows a magnified view of the ramp 307, as referenced by the cross-hatched region in FIG. 7C.

With regard to the closable sealing member 228, in a preferred embodiment, a portion of the substantially rigid zone forms a sealing member 309A, and a portion of the substantially flexible zone forms a seal 309B, whereby the sealing member 309A can rotate about hinge 310 and engage the seal 309B with the sample entry port 295 when in a closed position, thus providing an air-tight seal. Alternatively, the air-tight seal may be formed by contact of two flexible materials, e.g., TPE on TPE. Optionally, the sealable sample entry port 295 also includes a vent hole (not shown). In an alternative embodiment, a portion of the substantially rigid zone forms a sealing member, and a portion of the substantially flexible zone forms a perimeter seal around the sample entry port, whereby the sealing member can rotate about a hinge and engage the perimeter seal when in a closed position, thus providing an air-tight seal. Alternatively, the perimeter seal may be formed by contact of two flexible materials. In yet another embodiment, the sealing member may include a slidable closure element as described in pending US 20050054078, the entirety of which is incorporated herein by reference.

Other features of the cartridge, shown in FIGS. 7A-7E and 8A-8E, include a portion of the substantially flexible zone 315 positioned over the pouch area or recessed region 266. In alternative embodiments, the substantially flexible zone 315 may include a generic symbol description to indicate to the user that pressure should not be applied to the substantially flexible zone 315 by the individual. For example, the symbol may comprise an embossed circle with a crossbar for providing a surface that can accommodate an actuator feature of instrument 102 (shown in FIG. 2) to apply a force and burst the underlying pouch 206. The thickness of the plastic in the substantially flexible zone 315 is most preferably about 400 μm and preferably from about 200 to about 800 μm. Essentially, the substantially flexible zone 315 should be sufficiently thin to flex easily, but sufficiently thick to maintain physical integrity and not tear.

With regard to the sensor or sensors used in the cartridge, the sensor recess 230 preferably contains a sensor array generally comprised of a plurality of sensors for a plurality of different analytes (or blood tests). Thus, the cartridge may have a plurality of sensor recesses each with at least one sensor 205. FIG. 9A, for example, shows three sensor recesses 230A, 230B, and 230C, containing three sensor chips, 205A, 205B, and 205C respectively. In the embodiment shown, the first chip has four sensors, the second three sensors and the third two sensors; thus, the sensor array comprises nine different sensors.

The analytes/properties to which the sensors respond generally may be selected from among pH, $pCO_2$, $pO_2$, glucose, lactate, creatinine, urea, sodium, potassium, chloride, calcium, magnesium, phosphate, hematocrit, PT, APTT, ACT(c), ACT(k), D-dimer, PSA, CKMB, BNP, TnI and the like and combinations thereof. Preferably, the analyte is tested in a liquid sample that is whole blood, however other samples can be used including blood, serum, plasma, urine, cerebrospinal fluid, saliva and amended forms thereof. Amendments can include dilution, concentration, addition of regents such as anticoagulants and the like. Whatever the sample type, it can be accommodated by the sample entry port of the device.

As the different tests may be presented to the user as different combinations in various cartridge types, it may be desirable to provide an external indication of these tests. For example, the three tests pH, $pCO_2$ and $pO_2$ may be combined in a single cartridge. These tests are used by physicians to determine blood gas composition and this type of cartridge is generally designated as G3+. For ease of recognition by the user, this designation may optionally be embossed (during or after molding) into the substantially rigid or flexible region of the cartridge, for example on the plastic in the thumb well 291 area. The optional product identification label may or may not be engraved or embossed. For example, in other embodiments, a sticker may be applied to the cartridge to provide the desired identification. In other aspects, laser marking, thermal transfer printing, pad printing, or ink jet printing are employed for this purpose. Clearly, other designations or symbols may optionally be used for other test combinations and located at different places on the exterior of the cartridge. Note also that different colors of the flexible plastic portion may be used, e.g., red for a G3+ and another color for another type. Alternatively, color may be used in a different way for cartridges that require the blood sample to have a specific anticoagulant added to the sample when the sample is drawn, for example, into a Vacutainer™ device. These commonly used blood collection devices use different colored plastic tops to indicate the type of anticoagulant. For example, green-tops code for lithium heparin and purple-tops code for potassium ethylenediamine tetraacetic acid (EDTA). Thus, a BNP test that requires sample collected in a purple-topped tube may also be a cartridge with a purple flexible molded portion. Likewise a green combination would be appropriate for a TnI test. Such combinations make user errors associated with sample collection with an inappropriate anticoagulant less likely.

Note that the cartridges may be managed by an inventory control system at the point of care, for example, by the processes described in U.S. Pat. No. 7,263,501, which is jointly owned and incorporated herein by reference in its entirety.

Generally, the cartridge of the present invention comprises a single-use disposable device that is used in conjunction with a portable instrument that reads the sensor signals. Preferably, the sensors are microfabricated, or at least manufactured in a high-volume reproducible manner. The fundamental operating principles of the sensor can include, for example, electrochemical, amperometric, conductimetric, potentiometric, optical, absorbance, fluorescence, luminescence, piezoelectric, surface acoustic wave and surface plasmon resonance.

In addition to the conception of a device, the present invention also includes a method of making a test cartridge for measuring an analyte in a liquid sample. This involves molding a housing comprising a cover portion including a first substantially rigid zone and a second substantially flexible zone and a base portion including a second substantially rigid zone, and when the complimentary halves are abutted they form one or more conduits. During the two-shot molding process, the flexible or rigid material forms at least one sensor recess 230. Once the molded housing is removed from the mold at least one sensor 205 is inserted into the at least one recess 230, along with other optional elements, e.g., a calibrant pouch and gasket, as described above. This is followed by closing the housing by abutting the complimentary halves, e.g., the cover and the base, to oppose and seal the housing together. This sealing process forms a cartridge with a conduit over at least a portion of the at least one sensor 205, thus enabling a fluid sample, e.g., blood, or other fluid, e.g., calibrant or wash fluid, to be moved through the one or more conduits and into contact with the at least one sensor 205.

Furthermore, the completed cartridge can also include a feature whereby the act of closing or opening the sample entry port 295 by the user stores or provides energy for subsequent actuations. For example, the act of closing or opening the sample entry port 295 may force the sample or calibrant fluid into a desired position in one or more of the conduits. In an alternative embodiment, the energy for subsequent actuations can be generated and/or stored prior to the cartridge being inserted into the housing of the analyzer by pressing a button or moving a lever, which could be subsequently released at a later time. For example, the button may compress a bellows to generate and/or store a charge.

Substantially Rigid and Substantially Flexible Zones

A preferred embodiment of the invention is illustrated in FIGS. 4A-4E (the cartridge 200 in closed form). The test cartridge 200, which preferably is capable of measuring an analyte (or property of the sample) in a liquid sample, comprises a molded housing including the cover portion 201 with the substantially rigid zone 220 formed of a substantially rigid material and the substantially flexible zone 222 formed of a substantially flexible material. Further, the molded housing includes the base portion 202 with the substantially rigid zone 224 formed of a substantially rigid material.

As used herein, the terms "substantially rigid" and "substantially flexible" are relative with respect to one another such that the substantially rigid zone or material is harder and exhibits less elasticity relative to the substantially flexible zone or material. In some exemplary embodiments, the substantially rigid zone or material has an absolute hardness value that is at least 25% greater than, e.g., at least 50% greater than, or at least 100% greater than, the hardness of the substantially flexible zone or material. As used herein, "hardness" refers to indentation hardness, whether determined by a Shore A/D Durometer, by a Rockwell hardness tester or other indentation hardness detector. In terms of elasticity, the substantially rigid zone or material preferably has a Young's modulus that is at least 10 times greater than, at least 100 times greater than or at least 1000 times greater than that of the substantially flexible zone or material.

The substantially rigid zone is formed of a substantially rigid material and preferably is molded from an injection moldable plastic. The substantially rigid zone, for example, may be molded from PET, more preferably from a PET copolymer capable of being injection molded, such as PETG (Eastman Chemical or SK Chemicals). Alternatively, the substantially rigid zones may be formed of ABS, polycarbonate (either poly aromatic or poly aliphatic carbonate, and preferably bisphenol A derived polycarbonate) or mixtures thereof. Likewise polystyrene, Topaz, acrylic polymers such as PMMA can also be used.

Although the specific properties of the substantially rigid material may vary, in preferred embodiments the substantially rigid material has a Shore D hardness of at least 50 Shore D, e.g., at least 80 Shore D, or at least 90 Shore D. In terms of Rockwell R hardness, the substantially rigid material preferably has a hardness of at least 50, at least 80 or at least 100, e.g., from about 50 to 130, from 90 to 120 or from 100 to 110. The substantially rigid material preferably has a specific gravity of greater than about 1.0, e.g., from 1.0 to 1.5, or from 1.2 to 1.3. As indicated above, the substantially rigid material preferably is substantially non-elastic, particularly when compared to the substantially flexible material. The substantially rigid material optionally has a Young's modulus of at least 2000 MPa, e.g., at least 2500 MPa or at least 2800 MPa. In terms of ranges, the substantially rigid material optionally has a Young's modulus of from 1500 to 3500 MPa, e.g., from 2000 to 3300 MPa, or from 2800 to 3100 MPa.

The substantially flexible zone is formed of a substantially flexible material and preferably is molded from an injection moldable thermoplastic elastomer, examples of which include various rubbers, Mediprene™, Thermolast K™, and mixtures thereof. Mediprene™ (e.g., Mediprene™ A2 500450M) is an injection-moldable VTC thermoplastic elastomer (TPE) formed from Styrene-Ethylene-Butylene-Styrene (SEBS) rubber, paraffinic oil and polypropylene. Additional substantially flexible materials that optionally are used in the present invention include one or more of nitrile-butadiene (NBR), hydrogenated NBR, chloroprene, ethylene propylene rubber, fluorosilicone, perfluoroelastomer, silicone, fluorocarbon, or polyacrylate. If the substantially flexible material is a rubber, the rubber preferably is selected from a series of rubbers having passed USP Class VI, the paraffinic oil is a medicinal white oil preferably □complying with the European Pharmacopoeia for □light liquid paraffin, and the polypropylene is a medical grade that has passed USP Class VI. Thermolast K™ TPEs also are injection moldable and are based on hydrated styrene block copolymers. Thermolast K TPEs also are USP Class VI certified and may be used, for example, in combination with many materials such as ABS and PC.

Although the specific properties of the substantially flexible material may vary, in exemplary embodiments the substantially flexible material has a Shore A hardness ranging from 30 to 90 Shore A, e.g., from to 40 to 60 Shore A or from 40 to 50 Shore A, as determined by ASTM D2240 (4 mm), the entirety of which is incorporated herein by reference. The substantially flexible material preferably has a modulus of elasticity at 100% strain as determined by ASTM D638, the entirety of which is incorporated herein by reference, of from 0.1 to 6 MPa, e.g., from 0.5 to 3 MPa or from 1 to 2 MPa, and at 300% strain of from 0.2 to 8 MPa, e.g., from 1 to 5 MPa or from 1 to 3 MPa. The substantially flexible material preferably has a specific gravity as determined by ASTM D792, the entirety of which is incorporated herein by reference, of from about 0.7 to 1.2, e.g., from 0.8 to 1.2 or from 0.9 to 1.1.

Ideally, the material used to form the substantially flexible zone exhibits good adhesion to the substantially rigid material. The two materials preferably exhibit a peel force at 50 mm of at least 4 N/mm, e.g., at least 6 N/mm or at least 8 N/mm, as determined according to the Renault D41 1916 standard, the entirety of which is incorporated herein by reference. In terms of ranges, the materials preferably exhibit a peel force at 50 mm of from 4 N/mm to 20 N/mm, e.g., from 6 N/mm to 10 N/mm or from 8 to 10 N/mm. In the Renault D41 1916 standard, a 130×20×2 mm substantially flexible material sample is adhered to a 130×22×2 mm substantially rigid material sample. A tensile testing machine is secured to a clamp on a short (20 mm) edge of the substantially flexible material, which is then peeled away from the underlying substantially rigid material, which is secured to a flexible clamp. Increasing force is applied on the tensile testing machine until the substantially flexible material has been peeled away from substantially rigid material by 50 mm.

Cartridge Manufacture

Two-shot injection molding has been used in the past to manufacture plastic objects such as pens, toothbrushes and automotive parts. Notably, the technique has been applied to computer keyboards (see U.S. Pat. No. 4,460,534) and other components, e.g., U.S. Pat. Nos. 6,296,796 and 4,444,711. The latter addresses molding a part with rubber and non-rubber portions. While U.S. Pat. No. 7,213,720 discloses a two-shot molding process using two different plastics where a device is formed by folding at a hinge portion, the concept has only been applied to devices for packaging of moisture sensitive items. See also related U.S. Pat. No. 7,537,137 and pending WO 2008030920. US 20080110894 describes a two-shot molded device with a hinge that acts as a vial for a stack of sensor strips and WO 2007072009 is similar but addresses a container with an RFID tag. Finally, U.S. Pat. No. 5,597,532 describes a folded test strip with a blood separation layer that excludes red cells, for example where the separation layer is treated with metal salts.

As shown in FIG. 5, a preferred embodiment for manufacturing a cartridge according to the invention involves two-shot molding of the cartridge housing. In a first step, the substantially rigid portion of the cover of the housing is injection molded into a first mold cavity using a substantially rigid material such as PETG. This part is then removed, preferably automatically, from the first mold cavity and inserted into a second mold cavity with voids corresponding to the desired location of the substantially flexible material. Once sealed, a substantially flexible material, e.g., thermoplastic Mediprene™, may be injection molded during a second step to form the complete cover. In a third step, the substantially rigid portion of the base of the housing is injection molded into a first mold cavity using a substantially rigid material such as PETG. While the above-described process has been described comprising first and second steps of forming a cover using a two-shot molding process and a third step of forming a base using a one-shot molding process, it should be understood that the cover could be formed using a one-shot molding process and the base formed using a two shot molding process, or both the cover and the base could be formed using a two-shot molding process depending on where the substantially rigid zone and the substantially flexible zones are to be located within the cartridge.

As would be appreciated by those skilled in the art, the materials that are injection molded, e.g., the substantially rigid material and the substantially flexible material, preferably are substantially free of moisture in order to avoid cracking. In a preferred embodiment, cycle time for the first and second injection and release steps is on the order of about five seconds for both steps. The actual mold design of the first and second shots may correspond, for example, to the parts as shown in various renditions of FIGS. 4A-4E, 7A-7E, and 8A-8E. Preferred mold dimensions are also inferred from the geometries described above for FIGS. 4A-4E and 5.

A preferred molding process is referred to in the art as lift and turn, rotary, core back sequencing or over molding. In a preferred embodiment, a lift and turn type mold contains two separate cavities. The first set forms the substantially rigid zone on the first shot before it is removed, rotated, and inserted into a second cavity, which forms the substantially flexible zone with the second shot. Each cavity includes one or more plastic injection gates. Molding is completed in a press of the appropriate tonnage for the clamping force and mold size. Molding presses of this general type are manufactured by Nestal, Engles, Roboshot among others.

The present invention is not limited to two-shot molding. For example, a three-shot mold allowing three different materials to be molded into a single part may be employed. Specifically, two separate areas of the flexible region can be formed, e.g., in different colors to aid in usability. Alternatively, the third shot can mold a desiccant plastic material into the housing. As several sensors are sensitive to moisture, the inclusion of a desiccant directly into the cartridge may be desired. While it is clear that multiple cavities can be used, both cost and manufacturing simplicity dictate that the fewest separate molding steps are used where possible.

In a preferred automated process, the cartridge assembly system orients incoming unpopulated cartridge housings for placement onto an automated main mover, which traverses the housing through the assembly process. At a first position, sensor chips may be picked from chip waffle trays or wafer film frames, oriented and placed into the chip wells within the cartridge housing. At a second position, inspection for damage may be completed by an intelligent automatic vision system before moving the housing. In the next step, the cartridge housing may be moved to the calibration pack station, which takes a calibration pack from a bulk feeder and inserts it into the cartridge housing. At the next station, the housing may be automatically abutted and closed (optionally with an intervening double-sided adhesive tape gasket), and the alignment pins may be hot or cold-staked to deform them into position such that the two halves of the housing are bonded or locked together, and thus form conduits therebetween. Other securing means may be employed as described above with reference to FIGS. 6A-6C. In the final step, the completed cartridges preferably are inspected before being placed on a continuous feed belt conveyer for delivery to an automated packaging unit.

In a preferred embodiment, the main mover transfers multiple parts through the line at the same time with each station operating independently but in concert. The entire system preferably operates at a rate to provide about one completed cartridge about every 0.5 to 3.0 seconds. The main mover, for example, may be a conveyer, linear motor, indexing conveyer, with open or closed loop control, or similar device.

The sensor chips preferably are picked and placed into position within the housing with either an articulated robotic arm or a precision X, Y, and Z gantry. Alternatively, positioning of the chips into the chip wells may be vision assisted or performed by a blind automated placement. Due to the compression fit of the chip into the chip well, that is, the slight deformation of the substantially flexible portion of the plastic housing that receives the chip, the placement mechanism preferably includes a spreading apparatus to deform the substantially flexible material before inserting the chip. After this step, a line-scan or area-scan inline camera may inspect the chip for irregularities or damage caused by the automated insertion. If a defect is detected, the offending housing is automatically removed from the assembly line and designated as either reworkable material or scrap.

Regarding the sealed pouch (calibration pack) insertion module, the bulk feeding and orientation of the sealed pouches are preferably by means of a vibratory type system, but alternatively may be based on a centrifugal, ladder or waterfall type system. When the sealed pouch is placed in the sealed pouch recessed region within the base, it may also be staked or pinned in place to prevent movement.

In the present invention, integrally molded alignment prongs improve cover to base alignment while also providing the clamping force necessary to seal the base by methods such as cold-staking, heat-staking, swaging, ultrasonic welding or laser welding. These alignment prongs can also be modified to incorporate a self-aligning snap together fitting. In the preferred manufacturing process, the cover half of the cartridge is abutted with the complimentary base half engaging the alignment prongs with their respective alignment holes, and cold-staking deforms the end of the alignment prongs effectively clamping the cover half and base half together. Optionally, but less preferred, is the use of an adhesive or formable resin, e.g., epoxy.

After the staking process, the cartridge may be packaged in a moisture resilient container, preferably a pouch formed of a thermoformable material such as PETG, Polystyrene or a plastic laminate with a foil layer. The primary package may then be fed into a secondary packaging unit for boxing and overpacking.

Capillary Stop

Figure 10:
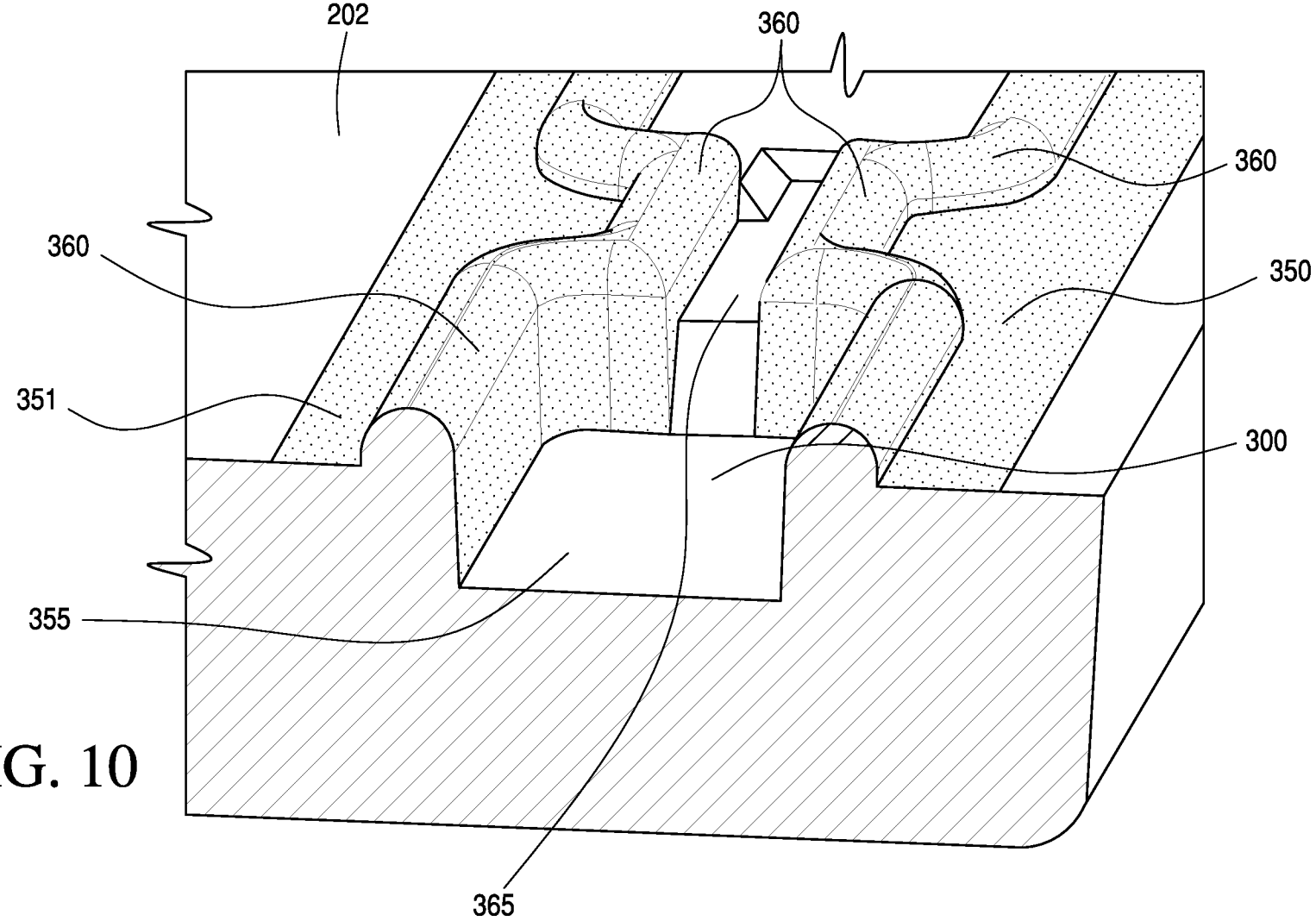
FIG. 10 is a magnified perspective view of a capillary stop region according to one aspect of the invention.

FIG. 10 shows a magnified view of a capillary stop region, as referenced by cross-hatched region 297 in FIG. 7A, according to an alternative embodiment of the invention. Portions of the substantially flexible zone 350 and 351 form two of the walls of a conduit, e.g., the sample holding chamber 300 or the conduit 275. In addition, a portion of the substantially rigid zone 355 forms at least one of the walls of the conduit. In an embodiment, when in the closed and sealed position, substantially flexible zones 350 and 351 form a gasket, which essentially determines and defines the position of conduit. With respect to FIGS. 4A-4E, the complimentary top portion 201 of the housing (not shown) is abutted with the bottom portion 202 to contact the exposed surface of the substantially flexible zones 350 and 351, thus enclosing the space below to form the conduit. In this respect, the gasket defines the geometry and dimensions of the conduit. Note that the cross-sectional area may change along the conduit but is generally in the range of from about 0.1 to about 10 $mm^2$, and typically about 1 mm×2 mm in the region of the conduit 275 above the sensor region 230. Note also that the gasket further comprises a compliant sealing ridge 360A which assists in preventing leakage of fluid and/or air out of the conduit during operation, i.e., assuring the conduit is liquid-tight and/or air-tight. Note that the portion of 360A that narrows in on either side (see ridges 360B in FIG. 10) forms a capillary stop, i.e., a point in the conduit where sample, e.g., blood sample, stops when the cartridge is inoculated with a blood sample. The well defined stop also enables subsequent metering of a defined sample volume. Furthermore, an elevated rigid portion 365 stands slightly proud of adjacent rigid portions. This also acts to narrow the cross-sectional area of the capillary stop. To move the blood beyond the capillary stop requires displacement of air from an air bladder 370 (shown in FIGS. 7A and 7C), which is actuated by the instrument 102 (shown in FIG. 2) via the displaceable membrane 225 (shown in FIGS. 8A-8D. This combination of features ensures the sample is kept separate from any calibrant fluid during the analysis cycle. In an alternative embodiment, the capillary stop is provided by a small opening in gasket 210, e.g. a dye or laser cut hole, where the opening forms a narrowing between two portions of the conduit.

The invention described and disclosed herein has numerous benefits and advantages compared to previous devices. These benefits and advantages include, but are not limited to ease of use and the automation of most if not all steps of manufacture. While the invention has been described in terms of various preferred embodiments, those skilled in the art will recognize that various modifications, substitutions, omissions and changes can be made without departing from the spirit of the present invention. Accordingly, it is intended that the scope of the present invention be limited solely by the scope of the following claims.

We claim:

1. A method for forming a cartridge, comprising:

(a) forming by a two-step injection molding process at least one portion of a molded housing comprising two separate portions, the at least one portion of the two separate portions comprising a substantially rigid zone and a substantially flexible zone; and, (b) bonding the two separate portions to form a fluid channel formed by the two separate portions of the molded housing, wherein at least a portion of the substantially flexible zone forms a seal of the fluid channel.

2. The method of claim 1, wherein the two-step injection molding process comprises forming the substantially rigid zone in a first injection molding step and the substantially flexible zone in a second injection molding step.

3. The method of claim 1, wherein the substantially rigid zone is molded as a single contiguous zone.

4. The method of claim 1, wherein the substantially flexible zone is molded as a single contiguous zone.

5. The method of claim 1, wherein the substantially flexible zone is molded as a plurality of non-contiguous flexible zones.

6. The method of claim 1, wherein the substantially rigid zone is molded from acrylonitrile butadiene styrene (ABS), polycarbonate, polystyrene, Topaz, acrylic polymers, polymethylmethacrylate (PMMA), combinations of two or more thereof, or polyethylene terephthalate glycol (PETG).

7. The method of claim 1, wherein the substantially flexible zone is molded from a thermoplastic elastomer.

8. The method of claim 1, wherein the substantially flexible zone is molded from an injection moldable thermoplastic elastomer having modulus of elasticity at 100% strain of from 0.1 to 6 MPa.

9. The method of claim 1, wherein the substantially rigid zone is of a substantially rigid material, and the substantially flexible zone is of a substantially flexible material, wherein the substantially rigid material has a Young's modulus at least ten times higher than the substantially flexible material and/or the substantially rigid material has an absolute hardness value that is at least 25% greater than the hardness of the substantially flexible material.

10. A method for forming a cartridge, comprising:

(a) providing a molded housing comprising two separate portions, a first portion of the two separate portions comprises a substantially rigid zone and a substantially flexible zone, and a second portion of the two separate portions comprises a complementary substantially rigid zone; and, (b) bonding the two separate portions to form one or more conduits formed by the two separate portions of the molded housing, wherein a peripheral sealing ridge of the substantially flexible zone of the first portion of the two separate portions is a gasket to form at least a portion of the one or more conduits when matted against the complementary substantially rigid zone of the second portion of the two separate portions, wherein the substantially rigid zone is of a substantially rigid material, wherein the substantially flexible zone is of a substantially flexible material, and wherein the substantially rigid material has a Young's modulus at least ten times higher than the substantially flexible material and/or the substantially rigid material has an absolute hardness value that is at least 25% greater than the hardness of the substantially flexible material.

11. The method of claim 10, further comprising forming the first portion of the two separate portions by a two-step injection molding process.

12. The method of claim 11, wherein the two-step injection molding process comprising forming the substantially rigid zone in a first injection molding step and the substantially flexible zone in a second injection molding step.

13. The method of claim 11, wherein the substantially rigid zone is molded as a single contiguous zone.

14. The method of claim 11, wherein the substantially flexible zone is molded as a single contiguous zone.

15. The method of claim 11, wherein the substantially flexible zone is molded as a plurality of non-contiguous flexible zones.

16. The method of claim 11, wherein the substantially rigid zone is molded from acrylonitrile butadiene styrene (ABS), polycarbonate, polystyrene, Topaz, acrylic polymers, polymethylmethacrylate (PMMA), combinations of two or more thereof, or polyethylene terephthalate glycol (PETG).

17. The method of claim 11, wherein the substantially flexible zone is molded from a thermoplastic elastomer.

18. The method of claim 11, wherein the substantially flexible zone is molded from an injection moldable thermoplastic elastomer having modulus of elasticity at 100% strain of from 0.1 to 6 MPa.

19. A method for forming a cartridge, comprising:

(a) providing a molded housing comprising two separate portions, at least one portion of the two separate portions comprises a substantially rigid zone and a substantially flexible zone; and, (b) bonding the two separate portions to form a fluid channel formed by the two separate portions of the molded housing, wherein at least a portion of the substantially flexible zone forms a seal of the fluid channel, wherein the substantially rigid zone is of a substantially rigid material, wherein the substantially flexible zone is of a substantially flexible material, and wherein the substantially rigid material has a Young's modulus at least ten times higher than the substantially flexible material and/or the substantially rigid material has an absolute hardness value that is at least 25% greater than the hardness of the substantially flexible material.

20. The method of claim 19, wherein the substantially flexible zone is molded from an injection moldable thermoplastic elastomer having modulus of elasticity at 100% strain of from 0.1 to 6 MPa.

* * * * *